US011821594B2

(12) United States Patent
Cai

(10) Patent No.: US 11,821,594 B2
(45) Date of Patent: Nov. 21, 2023

(54) LIGHTING FIXTURE AND ITS COMPOSITE STRUCTURES

(71) Applicant: Yueqi Cai, Ningbo (CN)

(72) Inventor: Yueqi Cai, Ningbo (CN)

( * ) Notice: Subject to any disclaimer, the term of this patent is extended or adjusted under 35 U.S.C. 154(b) by 0 days.

(21) Appl. No.: 17/696,903

(22) Filed: Mar. 17, 2022

(65) Prior Publication Data

US 2022/0205600 A1 Jun. 30, 2022

(51) Int. Cl.

| | |
|---|---|
| ***F21S 2/00*** | (2016.01) |
| ***F21V 23/06*** | (2006.01) |
| ***F21S 4/28*** | (2016.01) |
| *F21Y 103/10* | (2016.01) |
| *F21Y 115/10* | (2016.01) |

(52) U.S. Cl.

CPC ..... *F21S 2/005* (2013.01); *F21S 4/28* (2016.01); *F21V 23/06* (2013.01); *F21Y 2103/10* (2016.08); *F21Y 2115/10* (2016.08)

(58) Field of Classification Search

CPC .. F21Y 2115/10; F21Y 2103/10; F21V 23/06; F21S 4/28

See application file for complete search history.

(56) References Cited

U.S. PATENT DOCUMENTS

| | | | |
|---|---|---|---|
| 2012/0212943 | A1 | 8/2012 | Stoltz |
| 2015/0289337 | A1 | 10/2015 | Murakami et al. |
| 2017/0254486 | A1 | 9/2017 | Verfuerth et al. |

FOREIGN PATENT DOCUMENTS

CN 214379147 U * 10/2021

* cited by examiner

*Primary Examiner* — Anabel Ton

(57) ABSTRACT

The present invention discloses a lighting fixture and combinations of such lighting fixtures. The lighting fixture consists of a light bar body, the light bar body consists of the first connecting part and the second connecting part, the first connecting structure is arranged on the first connecting part, the second connecting structure connecting to the first connecting structure is arranged on the second connecting part, the first connecting structure consists of a connecting block and the first conductive connector, the second connecting structure consists of a connecting groove and the second conductive connector, and the second conductive connector is arranged in the connecting groove. Several lighting fixtures can be spliced together by connecting end to end according to the actual situation and personal preference to form different styles, shapes, and structures.

14 Claims, 21 Drawing Sheets

LIGHTING FIXTURE AND ITS COMPOSITE STRUCTURES

TECHNICAL FIELD

The present invention relates to the field of the invention of a lighting fixture, particularly to a lighting fixture and its composite structures.

BACKGROUND

Lighting fixtures are necessary appliances for home lighting and public lighting. With the continuous increase of the people's aesthetic requirements, the splicing type lighting fixtures have been used frequently. However, the existing splicing type lighting fixtures are connected by cables, while the connection by cables requires the wiring, making the installation rather cumbersome. Especially when it is necessary to install the lighting fixtures at heights, it is difficult for electricians to install, splice, and wire the lighting fixtures. Therefore, the splicing type lighting fixtures connected by cables are no longer suitable for modern life.

SUMMARY

The present invention is to design a lighting fixture and its composite structures to solve the shortcomings of the above technology, and the specific methods are as follows.

The present invention designs a lighting fixture that consists of a light bar body, the light bar body consists of the first connecting part and the second connecting part, the first connecting structure is arranged on the first connecting part, the second connecting structure connecting to the first connecting structure is arranged on the second connecting part, the first connecting structure consists of a connecting block and the first conductive connector, the second connecting structure consists of a connecting groove and the second conductive connector, and the second conductive connector is arranged in the connecting groove.

As a preferred embodiment, the first conductive connector is inserted into the first hole of the first connecting part, and the contact part of the first conductive connector is exposed to the outside.

As a preferred embodiment, the connecting block and the first connecting part are arranged perpendicular to each other, a limiting bulge is arranged on the connecting block, the first positioning groove is arranged on the second connecting part near the connecting block, and a limiting clamping groove is arranged in the first positioning groove.

As a preferred embodiment, a positioning block is arranged on the connecting block, the positioning block is arranged perpendicular to the first connecting part and near the connecting block, and the second positioning groove is arranged on the second connecting part.

As a preferred embodiment, the light bar body consists of a shell, a light-transmitting body, and a luminous source, the shell and the light-transmitting body are fixed to form a lamp housing, the luminous source is arranged between the shell and the light-transmitting body, the first plug-in block is arranged on the first connecting part and inserted into the inner cavity at one end of the lamp housing, and the second plug-in block is arranged on the second connecting part and inserted into the inner cavity at the other end of the lamp housing.

As a preferred embodiment, the first catching groove is arranged on the wall of the inner cavity at one end of the lamp housing, the first catching block is arranged on the first plug-in block, and the first catching groove is inserted into the first catching groove.

As a preferred embodiment, the second catching groove is arranged on the wall of the inner cavity at the other end of the lamp housing, the second catching block is arranged on the second plug-in block, and the second catching groove is inserted into the second catching groove.

As a preferred embodiment, the second connecting part consists of the first side face, the second side face, and the third side face, all of which form the connecting grooves, the third holes are formed on the connecting groove of the first side face, the connecting groove of the second side face, and the connecting groove of the third side face respectively, the second conductive connector is inserted into such three third holes, and the first conductive connector is inserted into the second hole of the connecting block.

As another preferred embodiment, the light bar body consists of a shell, a light-transmitting body, and a luminous source, the shell and the light-transmitting body are fixed to form a lamp housing, the luminous source is arranged between the shell and the light-transmitting body, the first plug-in block is arranged on the first connecting part and inserted into the inner cavity at one end of the lamp housing, and the second plug-in block is arranged on the second connecting part and inserted into the inner cavity at the other end of the lamp housing.

As another preferred embodiment, the first catching groove is arranged on the wall of the inner cavity at one end of the lamp housing, the first catching block is arranged on the first plug-in block, and the first catching groove is inserted into the first catching groove.

As another preferred embodiment, the second catching groove is arranged on the wall of the inner cavity at the other end of the lamp housing, the second catching block is arranged on the second plug-in block, and the second catching groove is inserted into the second catching groove.

As another preferred embodiment, a groove body is arranged on the back of the lamp housing, a suspension frame is arranged in the groove body and connected to the inner wall of the groove body through a clamping structure, a threaded hole is arranged on the suspension frame, a bolt is connected to threaded hole through internal threads, a hanger frame is arranged above the suspension frame, is connected to the suspension frame by a connecting frame, and consists of the first plate body and the first hook body at one end of the first plate body, the second plate body is arranged between the hanger frame and the suspension frame, the second hook body is arranged on the second plate body on the side corresponding to the first hook body, a suspension plate is arranged above the first plate body, a suspension rod is arranged on the suspension plate, the bottom face of the suspension plate and the screw end face of the bolt contact each other, and the top faces of both ends of the suspension plate contact the limiting parts of the first hook body and the second hook body.

As another preferred embodiment, there are three plugs, i.e. the first plug, the second plug, and the third plug, among which the first plug is inserted into the connecting groove on the first side face, the second plug is inserted into the connecting groove on the second side face, and the third plug is inserted into the connecting groove on the third side face.

As another preferred embodiment, there is a sealing cap that is covered on the end face of the first connecting part, and there is a sleeve body formed in the sealing cap and sleeved onto the connecting block.

On the other hand, a composite structure of lighting fixtures consists of several lighting fixtures according to the Claims, in two adjacent lighting fixtures, the first connecting part of one lighting fixture and the second connecting part of the other lighting fixture contact each other, and the connecting block of one lighting fixture is inserted in the first positioning groove of the other lighting fixture, so the limiting bulge of one lighting fixture is buckled into the limiting clamping groove of the other lighting fixture, the positioning block is inserted into the second positioning groove, and the first conductive connector is inserted into the connecting groove and contacts the second conductive connector, thus forming a conductive connection. The structure ensures that four lighting fixtures can be spliced to form a box-shaped splicing type composite lighting fixture.

On the other hand, a composite structure of lighting fixtures consists of several lighting fixtures according to the Claims, in two adjacent lighting fixtures, the first connecting part of one lighting fixture and the second connecting part of the other lighting fixture contact each other, and the connecting block of one lighting fixture is inserted in the connecting groove of the other lighting fixture, so the first conductive connector is inserted into the connecting groove on any side face of the second connecting part and contacts the second conductive connector, thus forming a conductive connection. The structure can form an I-shaped splicing type composite lighting fixture, an L-shaped splicing type composite lighting fixture, or a T-shaped splicing type composite lighting fixture.

The present invention designs a lighting fixture and its composite structures. During the splicing of multiple lighting structures, in two adjacent lighting fixtures, the first connecting structure of one lighting fixture and the second connecting structure of the other lighting fixture match each other and form a conductive connection. Therefore, the splicing and installation of the lighting fixtures are rather convenient, and the installation process is simplified to improve the splicing and assembly efficiency. In addition, it is rather convenient to install the lighting fixtures at heights in the form of suspension, thus reducing the difficulty in the installation at heights.

DETAILED DESCRIPTION

Figure 1:
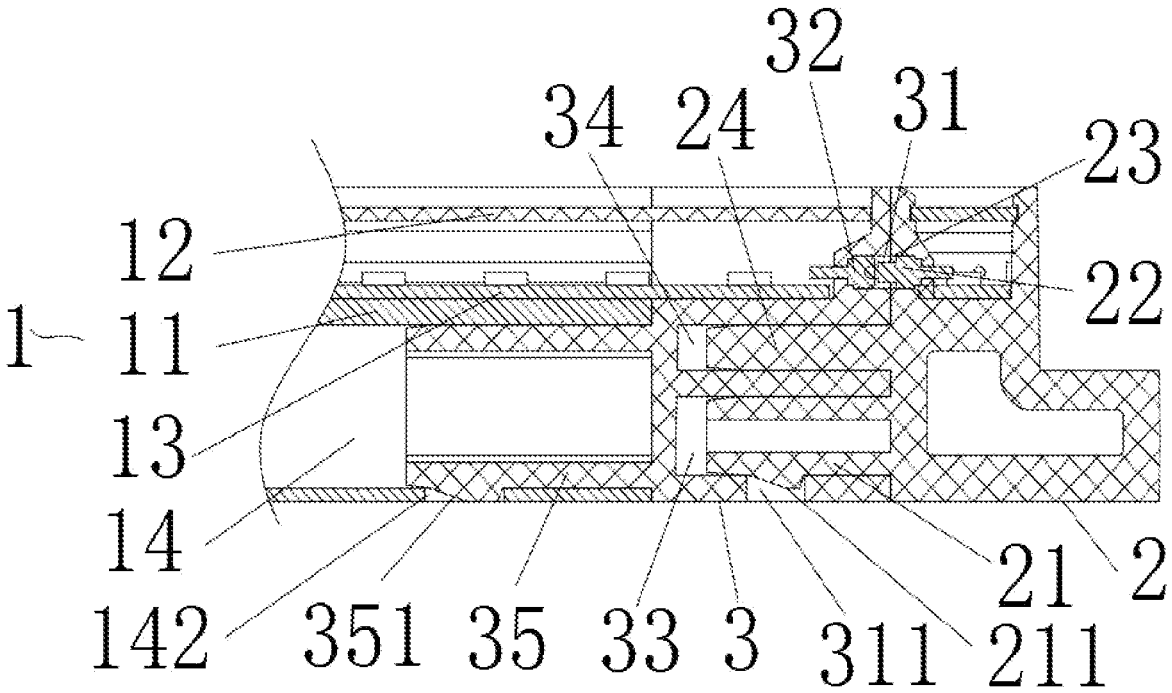
FIG. 1 is a structural diagram of a lighting fixture with the second connecting part.
Figure 2:
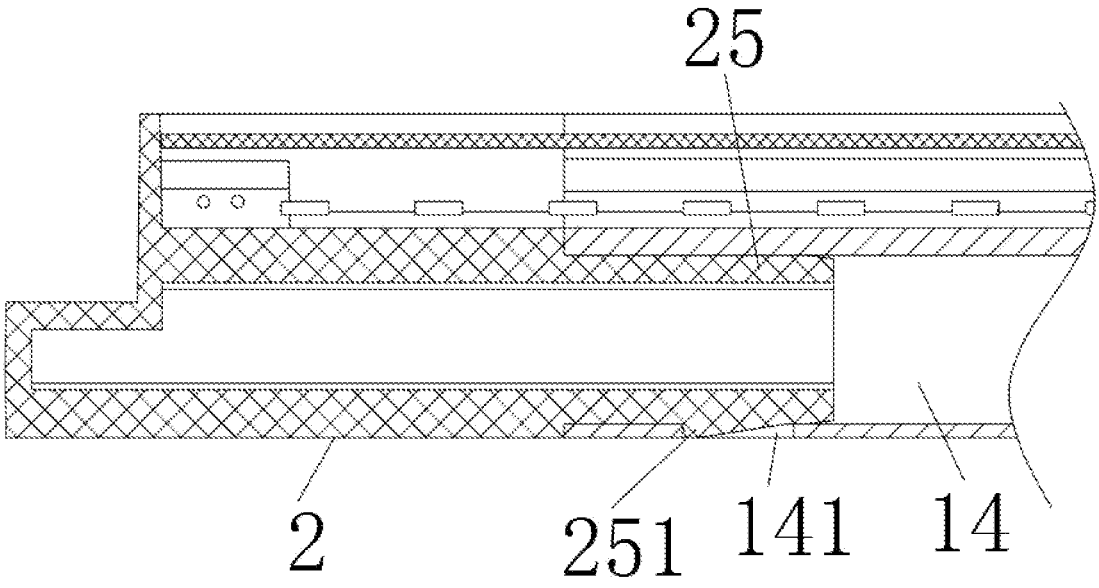
FIG. 2 is a structural diagram of a lighting fixture with the first connecting part.
Figure 3:
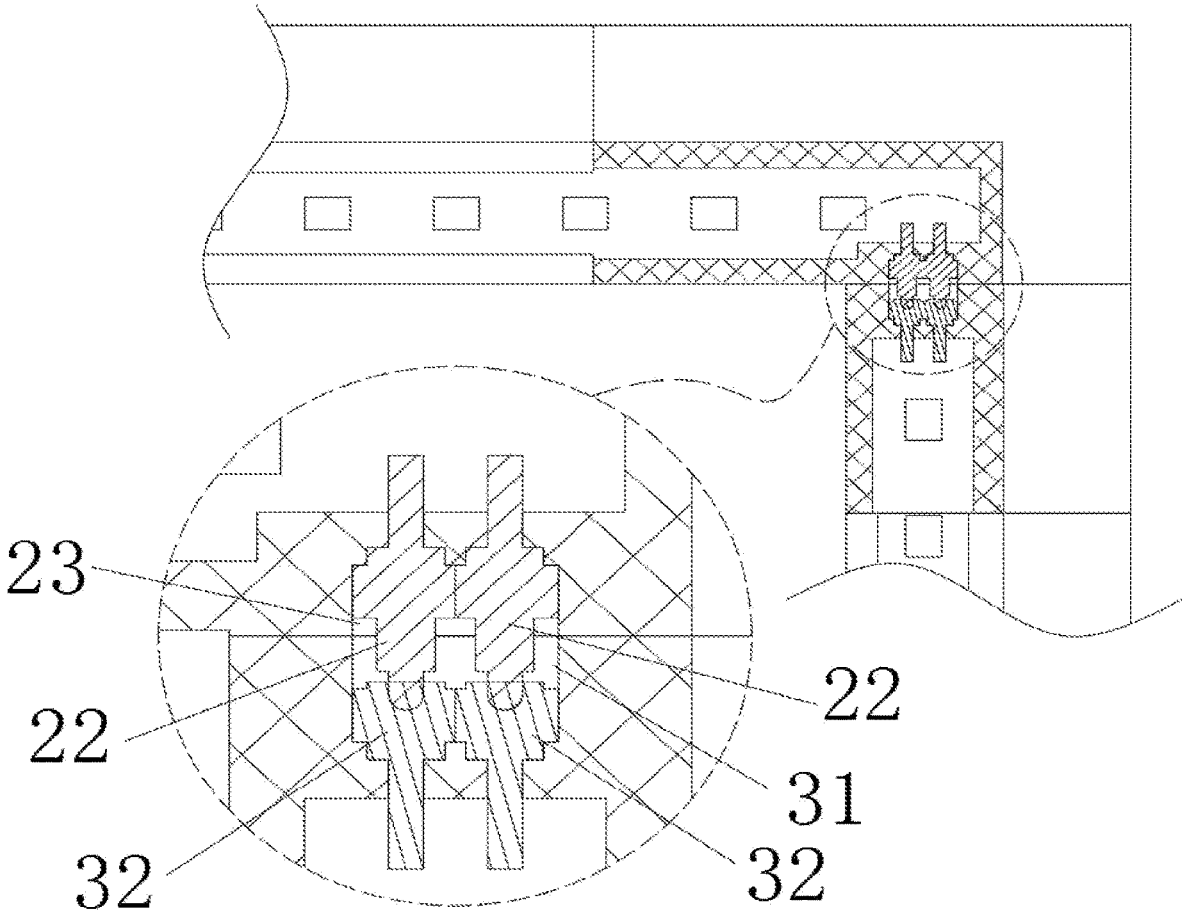
FIG. 3 is a structural diagram of the interconnection between the first connecting part and the second connecting part.
Figure 4:
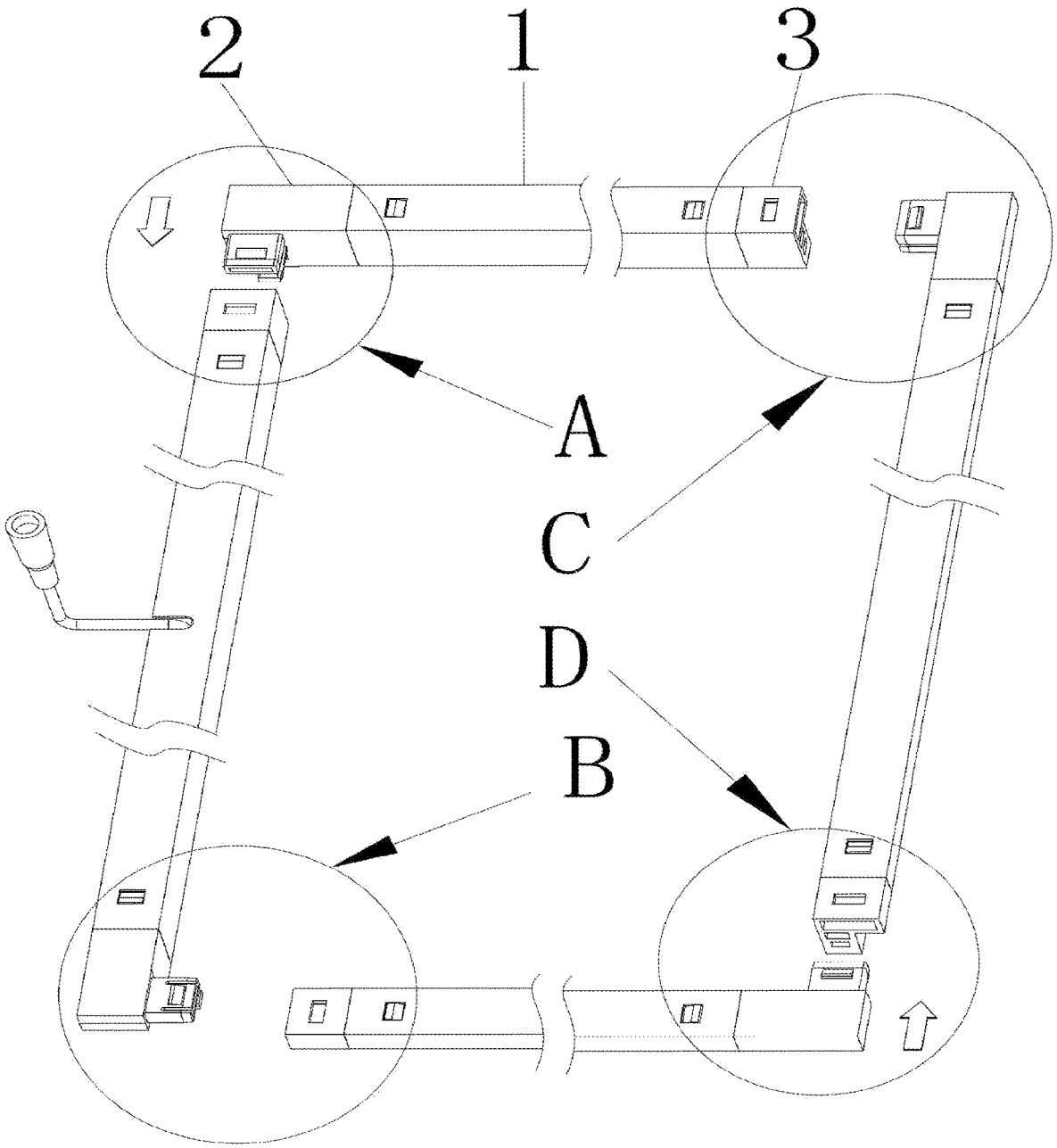
FIG. 4 is a structural diagram of four lighting fixtures to be spliced.
Figure 5:
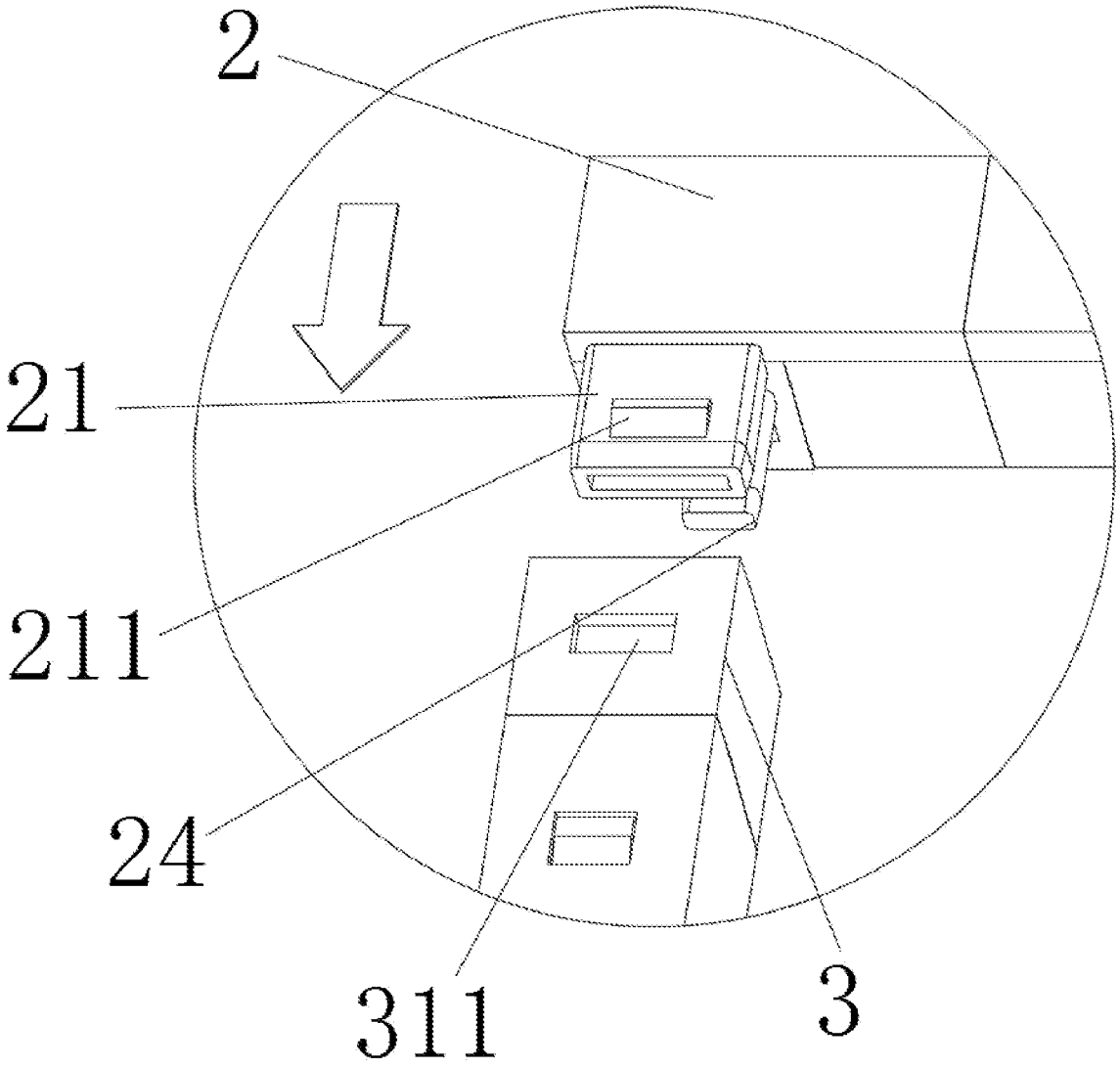
FIG. 5 is an enlarged view of Position A.
Figure 6:
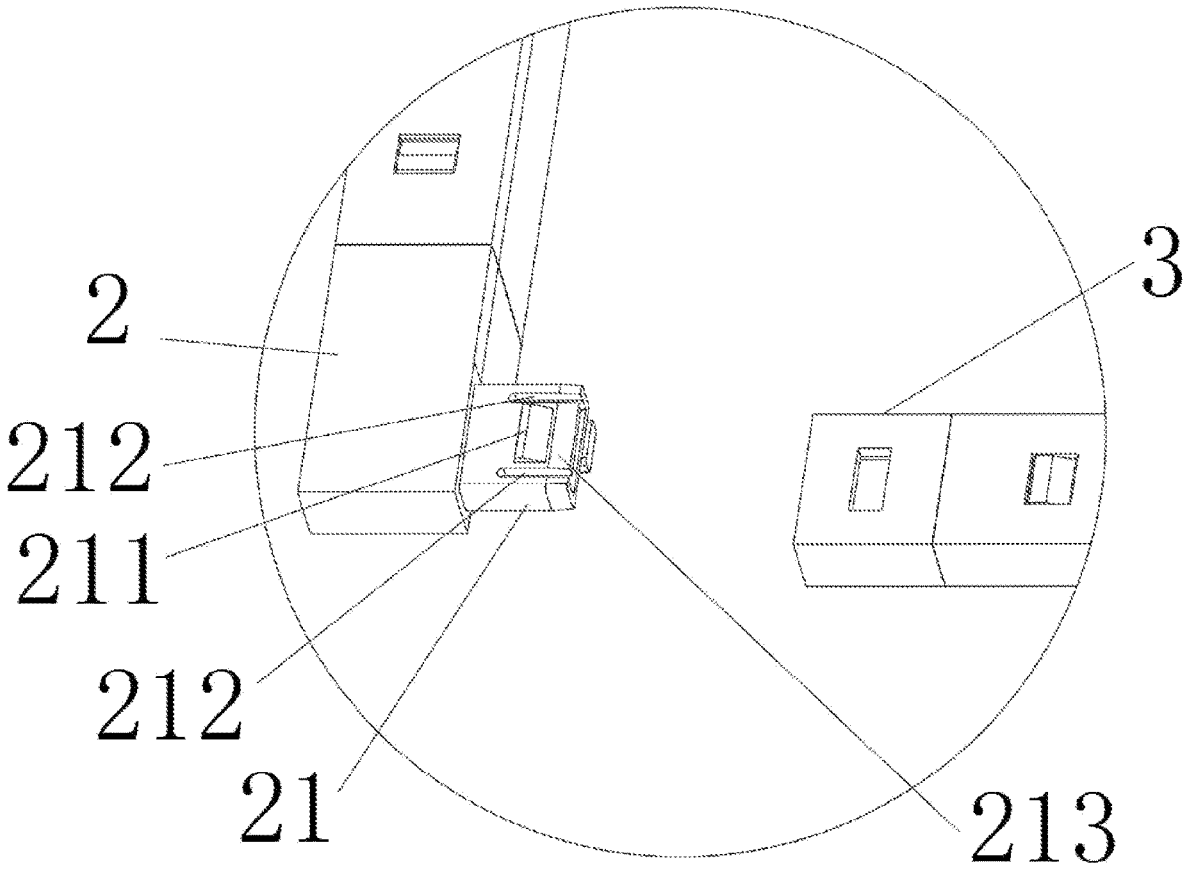
FIG. 6 is an enlarged view of Position B.
Figure 7:
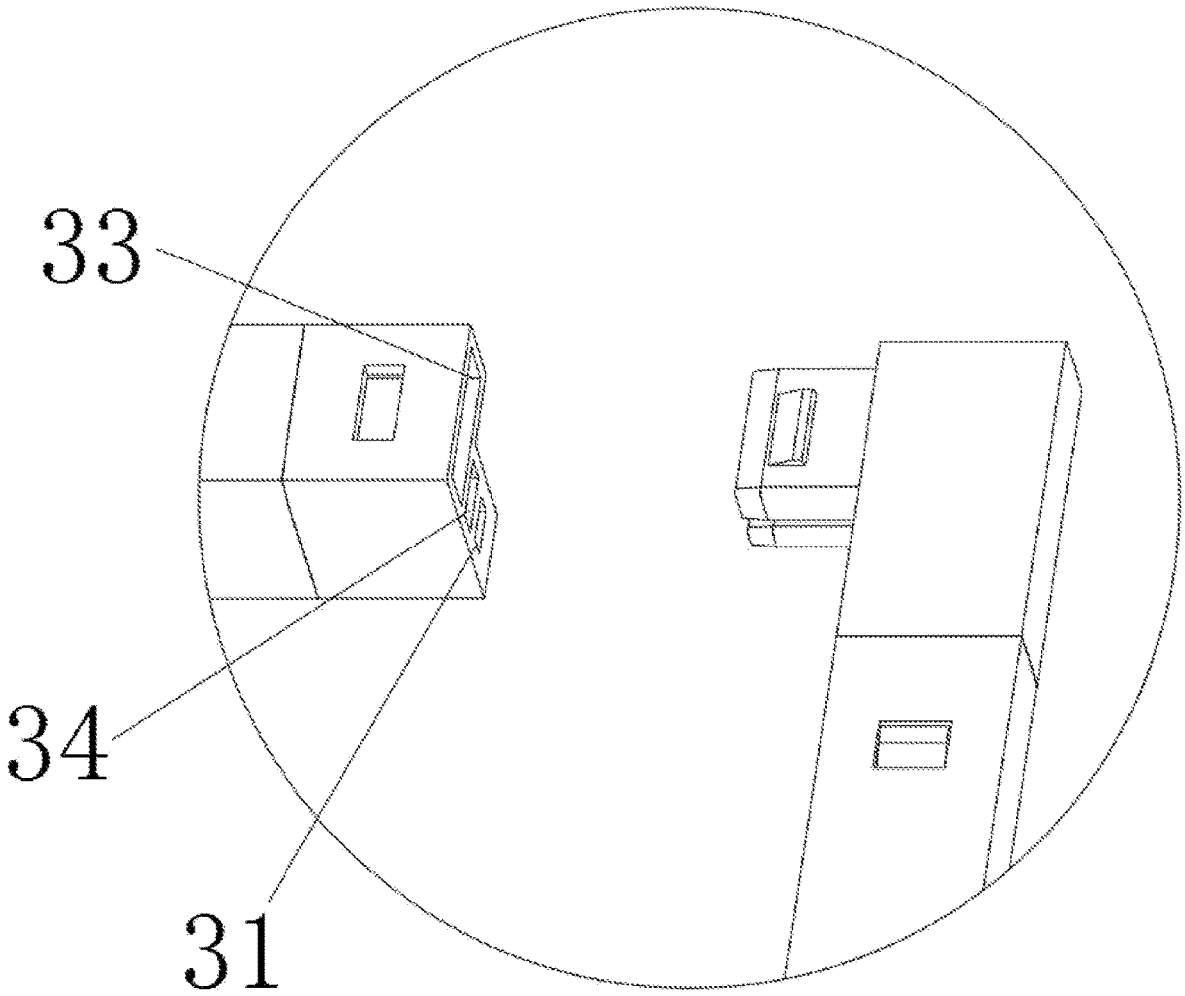
FIG. 7 is an enlarged view of Position C.
Figure 8:
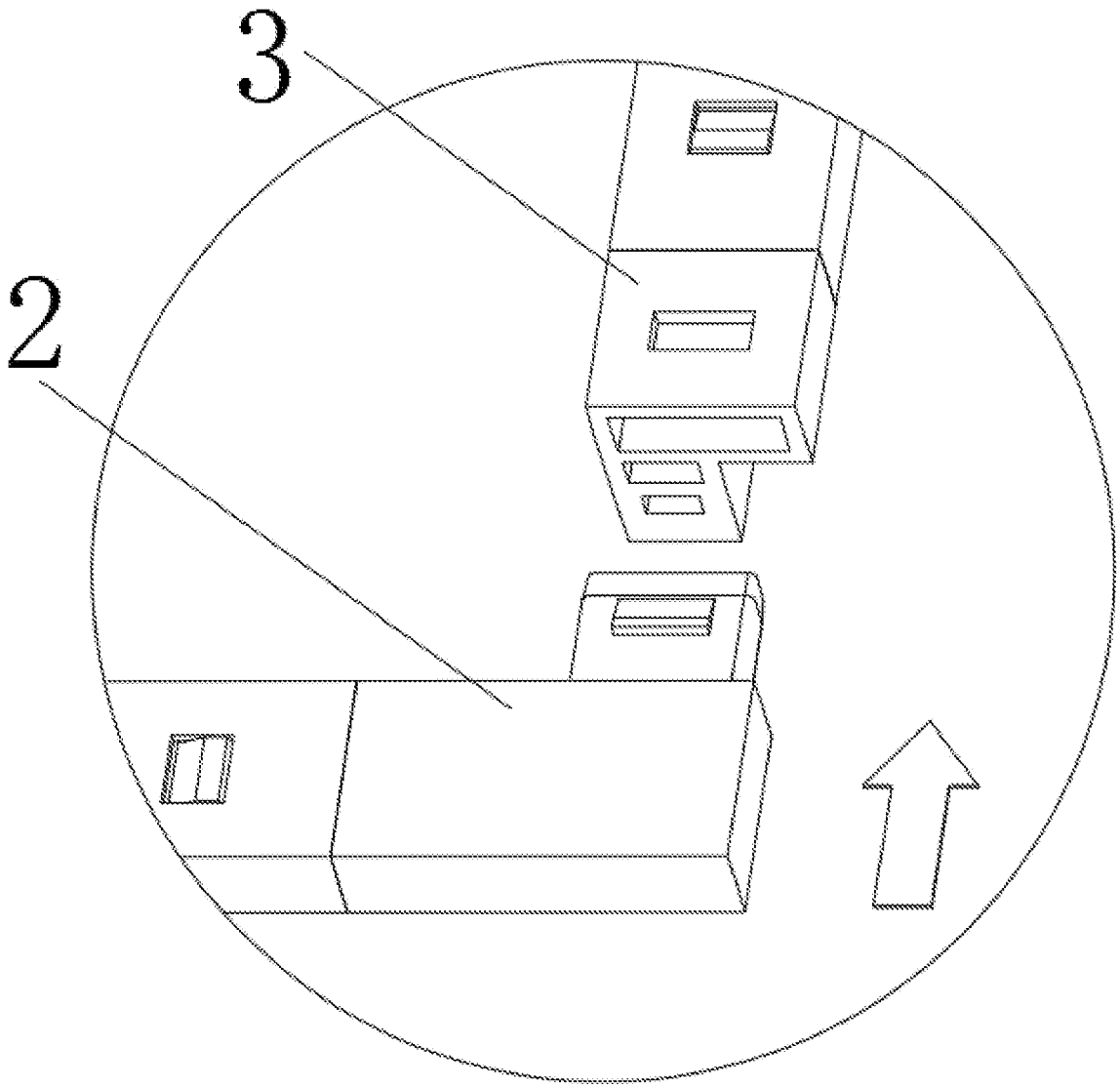
FIG. 8 is an enlarged view of Position D.
Figure 9:
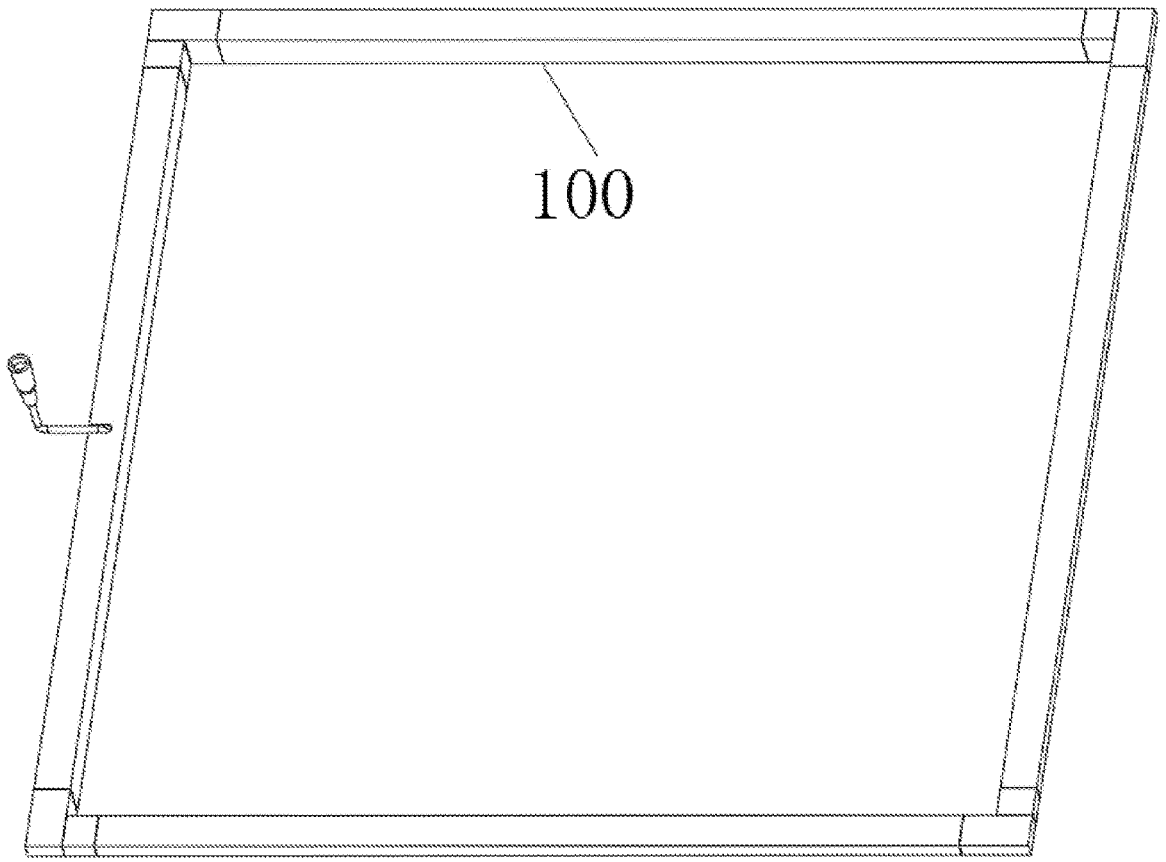
FIG. 9 is a schematic diagram (I) of a rectangular composite lighting fixture.
Figure 10:
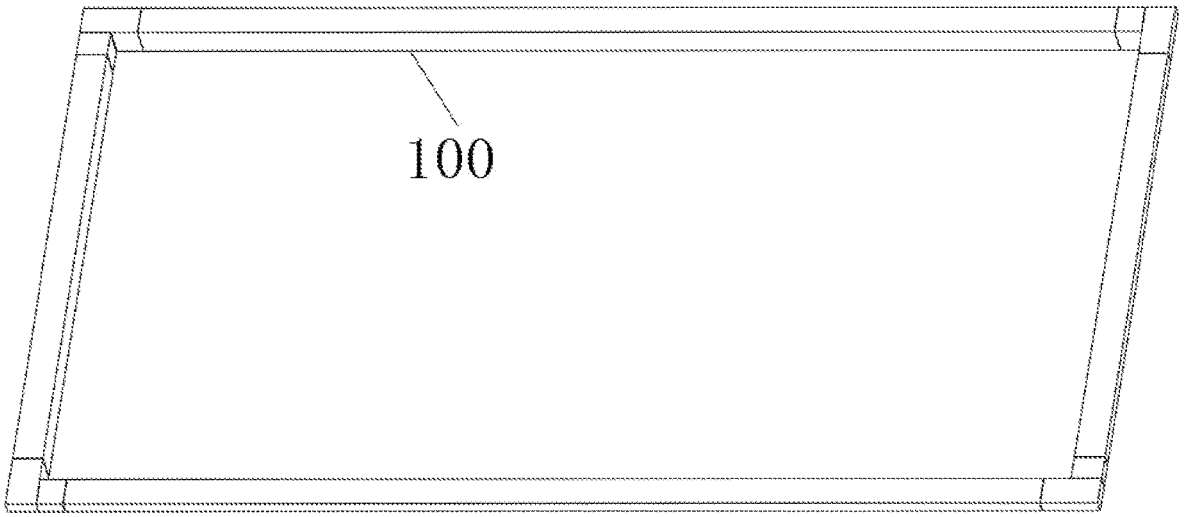
FIG. 10 is a schematic diagram (II) of a rectangular composite lighting fixture.
Figure 11:
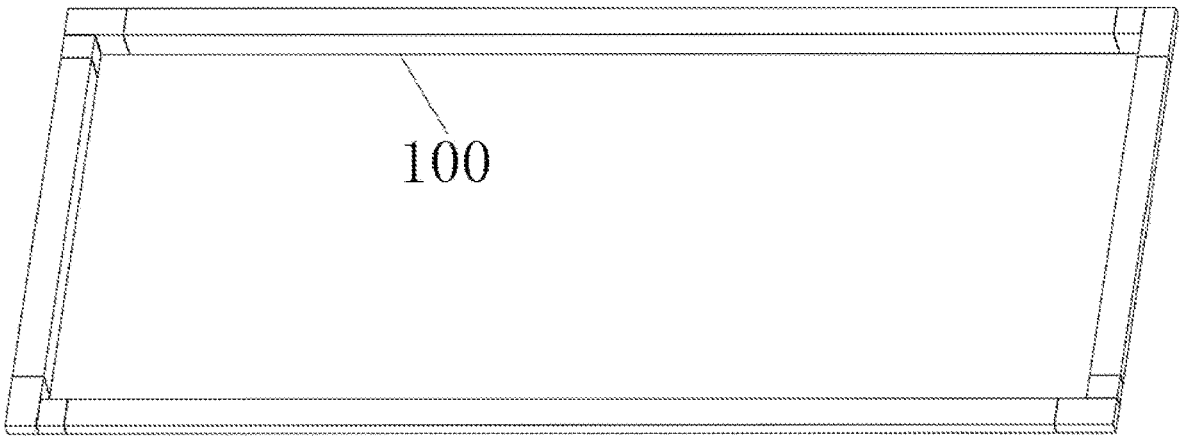
FIG. 11 is a schematic diagram of a square composite lighting fixture.
Figure 12:
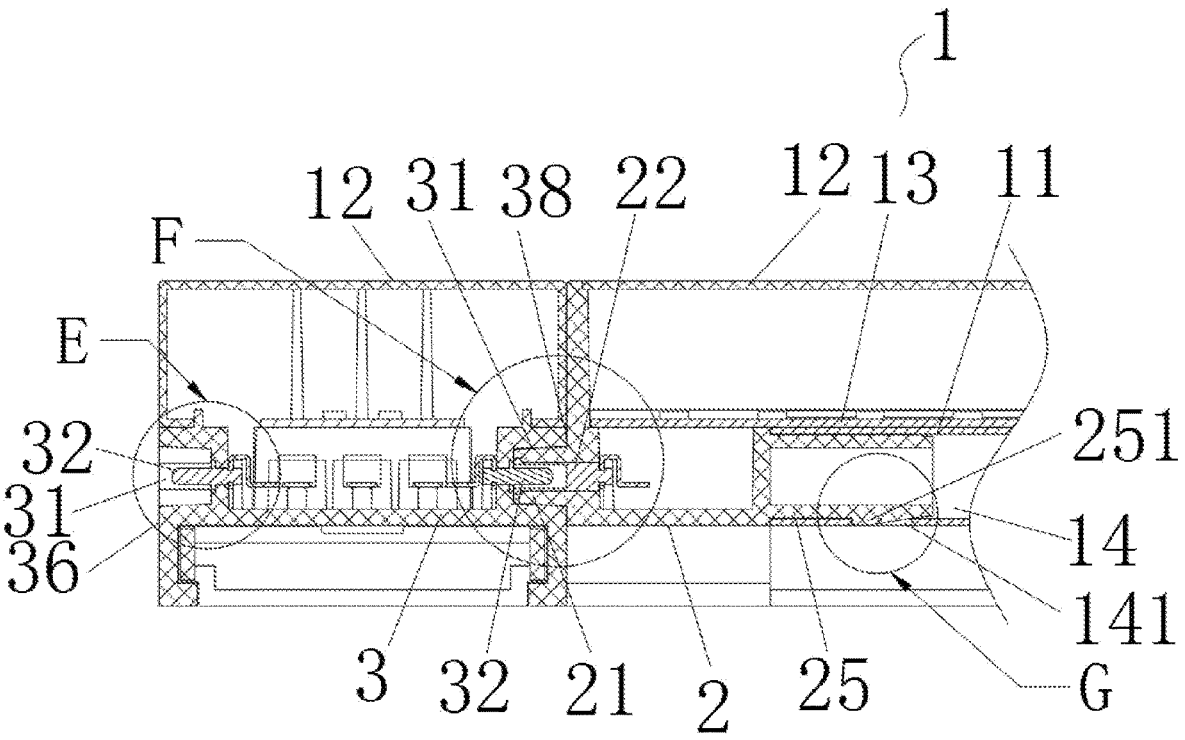
FIG. 12 is a structural diagram of another lighting fixture with the first connecting part.
Figure 13:
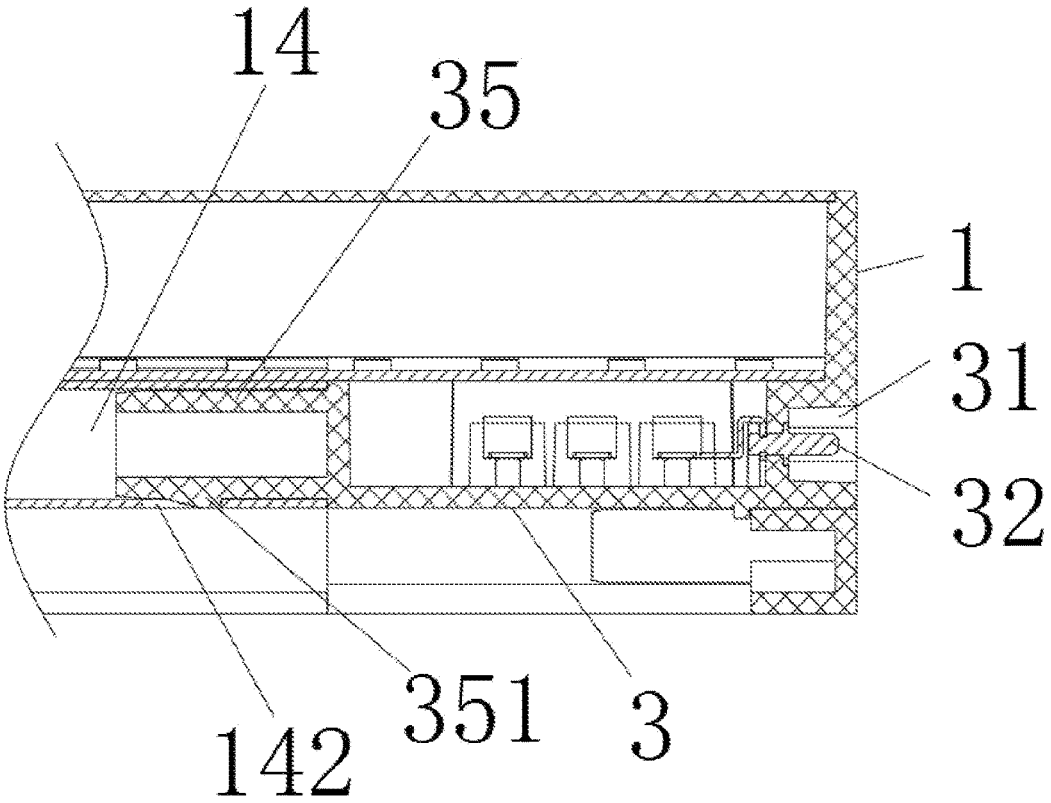
FIG. 13 is a structural diagram of another lighting fixture with the second connecting part.
Figure 14:
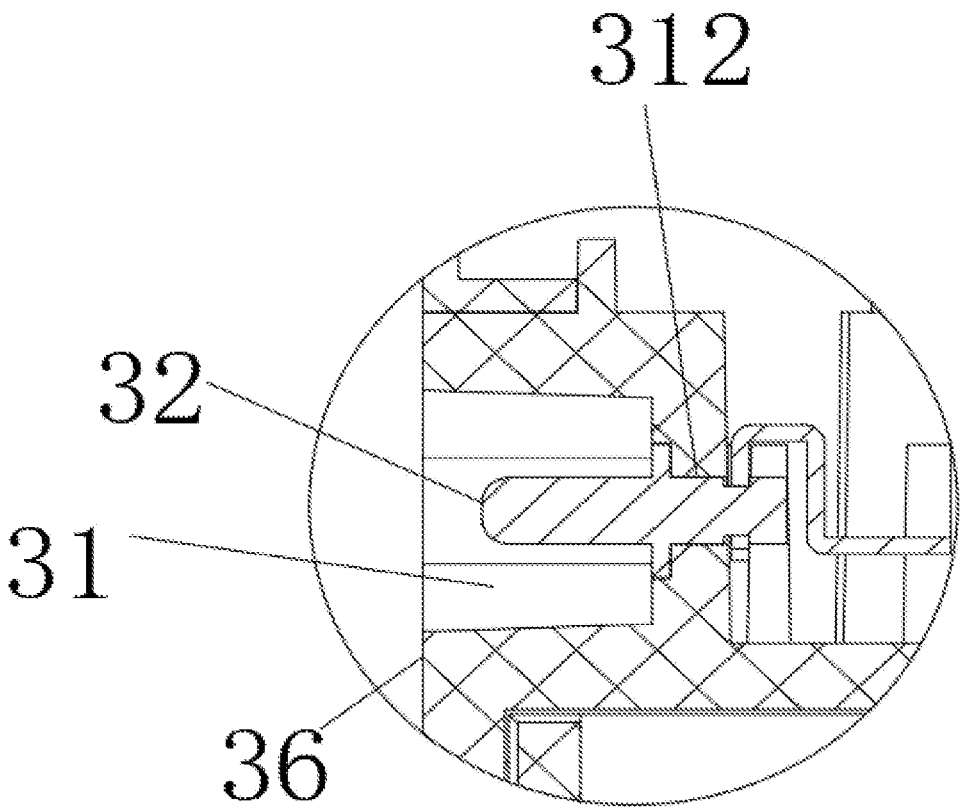
FIG. 14 is an enlarged view of Position E.
Figure 15:
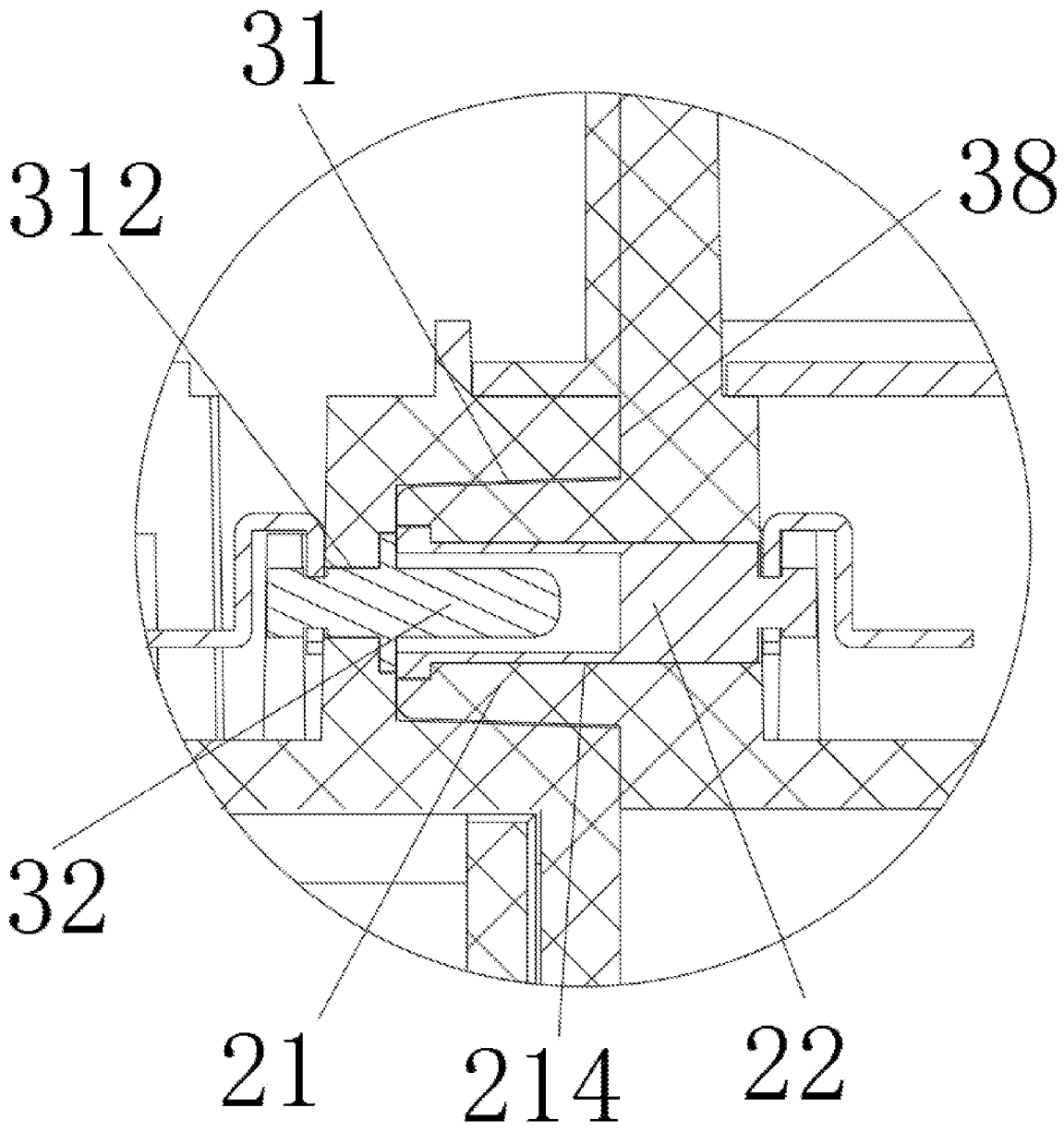
FIG. 15 is an enlarged view of Position F.
Figure 16:
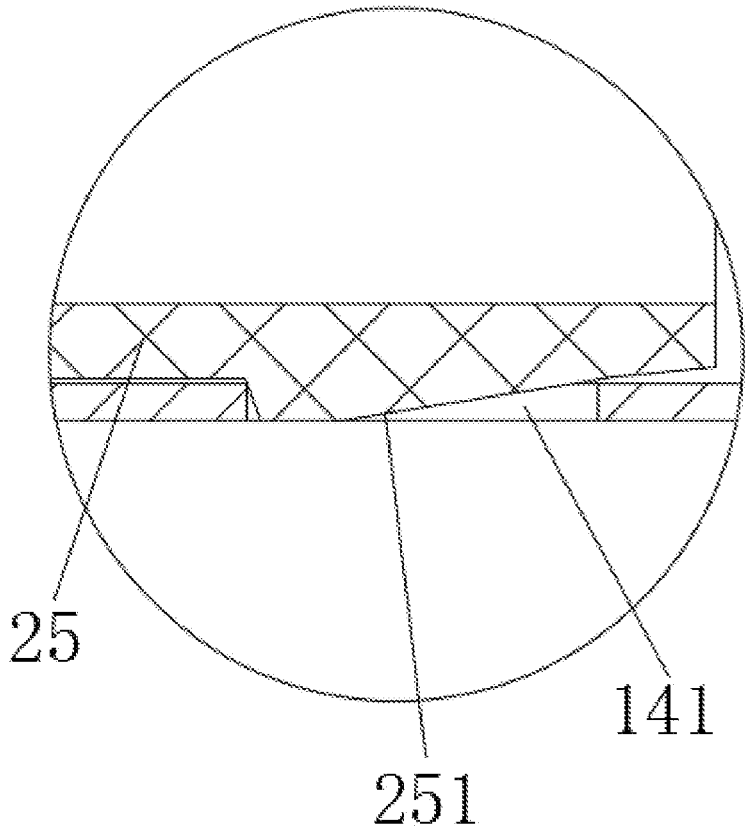
FIG. 16 is an enlarged view of Position G.
Figure 17:
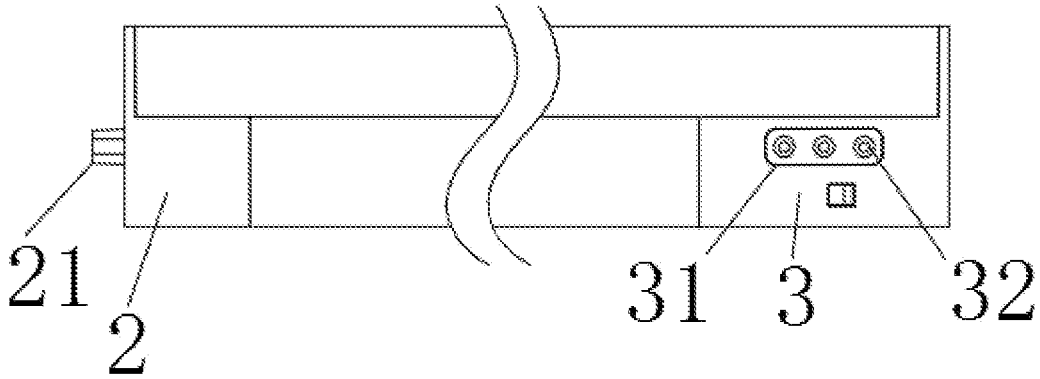
FIG. 17 is a front view of another lighting fixture.
Figure 18:
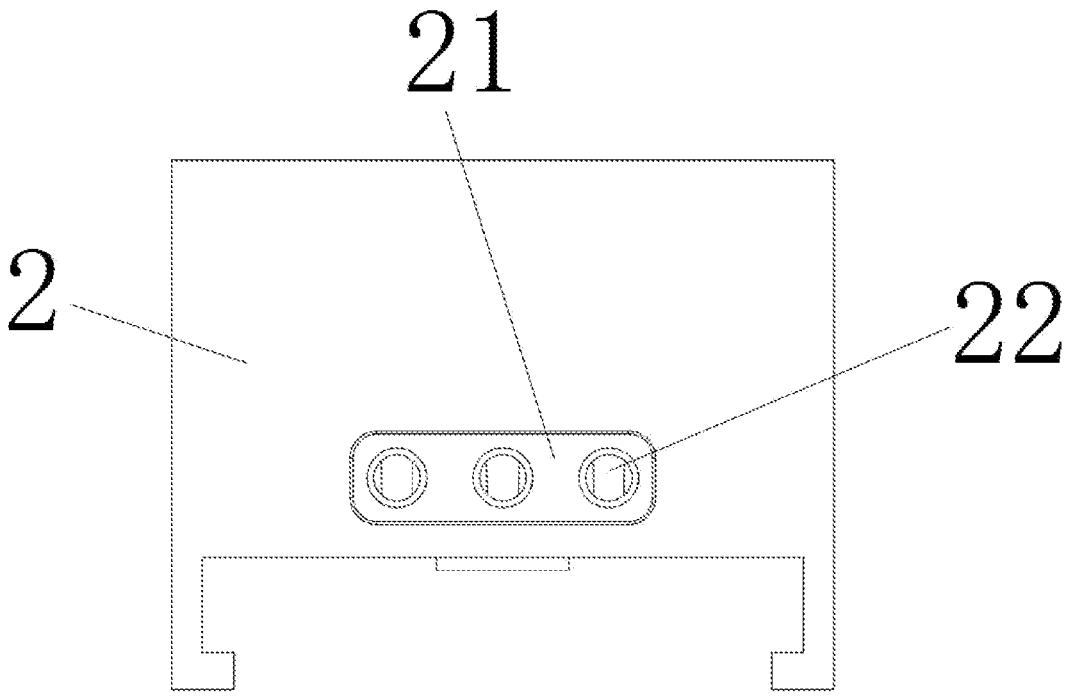
FIG. 18 is a left view of another lighting fixture.
Figure 19:
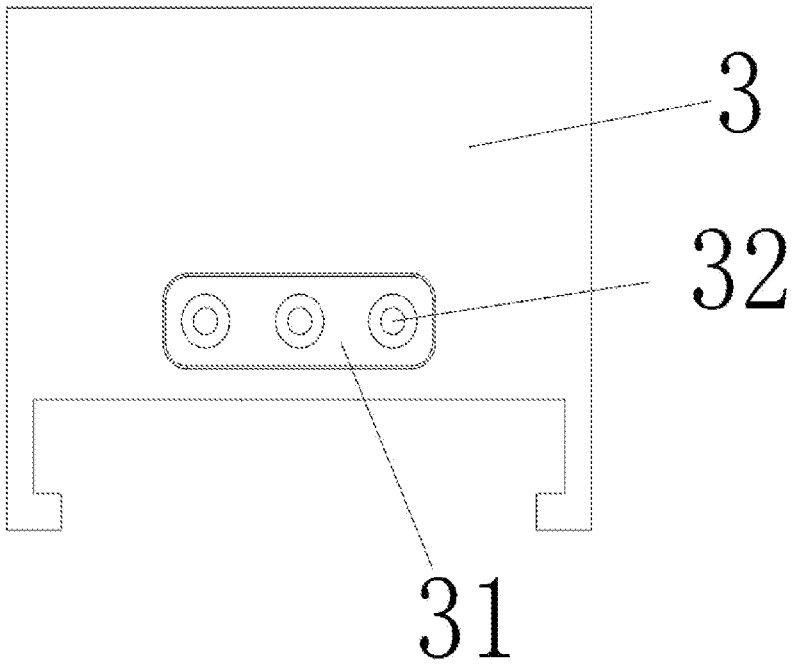
FIG. 19 is a right view of another lighting fixture.
Figure 20:
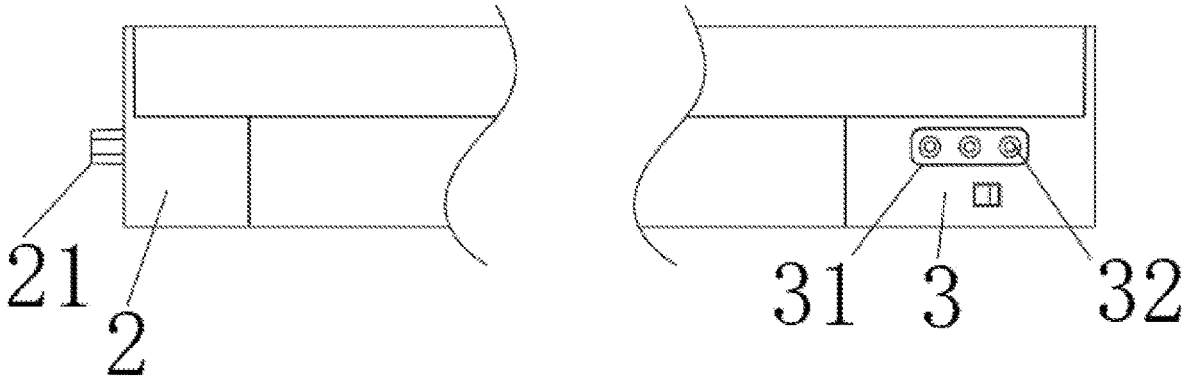
FIG. 20 is a rear side view of another lighting fixture.
Figure 21:
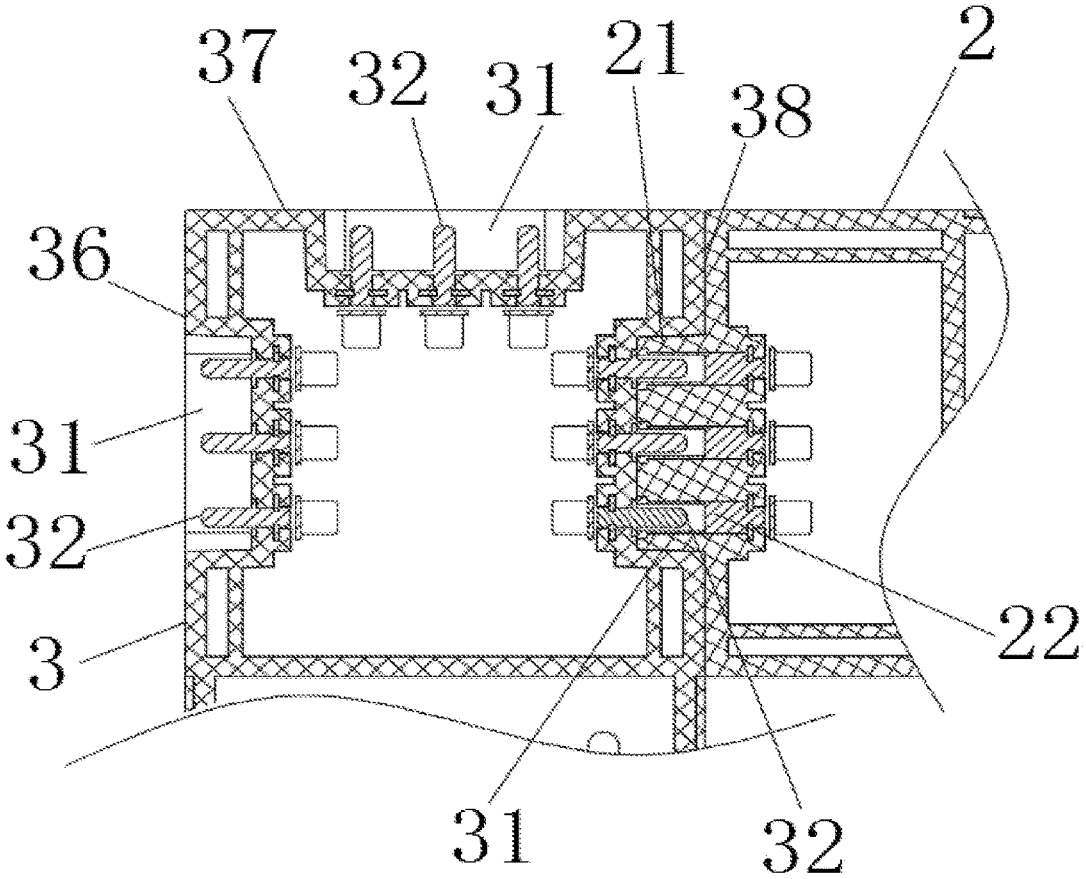
FIG. 21 is a section view of the contact structure between the first connecting part and the second connecting part.

Technical solutions in embodiments of the present prevention will be clearly and completely described with reference to the drawings in the embodiments of the present invention. Apparently, the embodiments described below are merely part, not all, of the embodiments of the present invention. Based on the embodiments described herein, all other embodiments obtained by those of ordinary skill in the art are within the scope of the present invention.

Embodiment 1

As illustrated in FIG. 1-FIG. 30, the lighting fixture described in this embodiment consists of a light bar body 1, the light bar body 1 consists of the first connecting part 2 and the second connecting part 3, the first connecting structure is arranged on the first connecting part 2, the second connecting structure connecting to the first connecting structure is arranged on the second connecting part 3, the first connecting structure consists of a connecting block 21 and the first conductive connector 22, the second connecting structure consists of a connecting groove 31 and the second conductive connector 32, and the second conductive connector 32 is arranged in the connecting groove 31. This embodiment describes a single lighting fixture that can be used for splicing, but the light bar body 1 consists of a shell 11, a light-transmitting body 12, and a luminous source 13. The shell 11 is a strip type shell 11 made of aluminum, a strip type shell 11 made of stainless steel, or a strip type shell 11 made of plastic.

Preferably, the shell 11 and the light-transmitting body 12 are fixed to form a lamp housing. Specifically, the light-transmitting body 12 can be a light-transmitting lampshade made of acrylic material, a mounting face 111 is arranged on the shell 11 for fixing the luminous source 13, sliding chutes 112 are arranged at both sides along the length of the mounting face 111, and positioning bodies 121 are arranged at the bottom of two longitudinal plates of the light-transmitting lampshade. When the light-transmitting lampshade is placed on the mounting face 111, two positioning bodies 121 are respectively inserted into the two sliding chutes 112 respectively. The first connecting part 2 and the second connecting part 3 are fixed at both ends of the lamp housing respectively to fix the light-transmitting lampshade.

The luminous source 13 is arranged between the shell 11 and the light-transmitting body 12. The luminous source 13 is an LED lamp panel to reduce the electricity consumed by luminescence. Specifically, two lamp panel fixing blocks 114 which are spaced apart from each other are arranged on the mounting face 111, the lamp panel clamping grooves 115 are arranged on the inner walls of two lamp panel fixing blocks 114, the LED lamp panel is arranged between two lamp panel fixing blocks 114, and two opposite sides of the LED lamp panel are placed in the lamp panel clamping grooves 115 respectively to fix the LED lamp panel. Alternatively, the LED lamp panel can be fixed on the mounting face 111 by bolts 8 or screws. The first plug-in block 25 is arranged on the first connecting part 2 and inserted into the inner cavity 14 at one end of the lamp housing, and the second plug-in block 35 is arranged on the second connecting part 3 and inserted into the inner cavity 14 at the other end of the lamp housing. Both the first connecting part 2 and the second connecting part 3 are plastic connecting shells of a hollow structure to ensure that the first connecting part 2 and the second connecting part 3 can be inserted onto the lamp housing respectively. The first conductive connector 22 and the second conductive connector are electrically connected to the LED lamp panel by cables.

Preferably, the first catching groove 141 is arranged on the wall of the inner cavity 14 at one end of the lamp housing, the first catching block 251 is arranged on the first plug-in block 25, and the first catching groove 141 is inserted into the first catching groove 141. Preferably, the second catching groove 142 is arranged on the wall of the inner cavity 14 at the other end of the lamp housing, the second catching block 351 is arranged on the second plug-in block 35, and the second catching groove 142 is inserted into the second catching groove 142. The structural arrangement makes it rather convenient for the assembly of the first connecting part 2 and the second connecting part 3 of the light bar body, improving the working efficiency during assembly.

Embodiment 2

Please refer to FIG. 1-FIG. 8. The lighting fixture described in this embodiment is a technical scheme based on Embodiment I. The first conductive connector 22 is inserted into the first hole 23 of the first connecting part 2, and the contact part of the first conductive connector 22 is exposed to the outside. The first conductive connector 22 and the second conductive connector 32 are terminals made of copper materials, achieving reliable conductivity. The contact part of the first conductive connector 22 is exposed to the outside, preparing for the contact conduction. Furthermore, there are two pieces of the first conductive connectors 22 that are positive terminal and negative terminal respectively. Accordingly, there are two pieces of the second conductive connectors 32 that are positive terminal and negative terminal respectively.

Preferably, the connecting block 21 and the first connecting part 2 are arranged perpendicular to each other, a limiting bulge 211 is arranged on the connecting block 21, the first positioning groove 33 is arranged on the second connecting part 3 near the connecting block 21, and a limiting clamping groove 311 is arranged in the first positioning groove 33. The long holes 212 are arranged on two opposite sides at the part containing the limiting bulge 211 on the connecting block 21, forming an elastic plate 213. Therefore, the limiting bulge 211 is arranged on the elastic plate 213, so it will be convenient for disassembly by using the elastic plate after the plug-in operation.

Preferably, a positioning block 24 is arranged on the connecting block 21, the positioning block 24 is arranged perpendicular to the first connecting part 2 and near the connecting block 21, and the second positioning groove 34 is arranged on the second connecting part 3. Preferably, the positioning block 24 is arranged between the connecting block 21 and the first conductive connector 22, the second positioning groove 34 is arranged between the connecting groove 31 and the first positioning groove 33, and the connecting block 21, the positioning block 24, and the first connecting part 2 are combined into an integral structure.

Embodiment 3

A composite structure of lighting fixtures described in this embodiment consists of several lighting fixtures according to Embodiment II, in two adjacent lighting fixtures 100, the first connecting part 2 of one lighting fixture and the second connecting part 3 of the other lighting fixture contact each other, and the connecting block 21 of one lighting fixture is inserted in the first positioning groove 33 of the other lighting fixture, so the limiting bulge 211 of one lighting fixture is buckled into the limiting clamping groove 311 of the other lighting fixture, the positioning block 24 is inserted into the second positioning groove 34, and the first conductive connector 22 is inserted into the connecting groove 31 and contacts the second conductive connector 32, thus forming a conductive connection. The concrete way of inserting the connecting block 21 of one lighting fixture into the first positioning groove 33 of the other lighting fixture is as follows: the connecting block 21 is inserted into the first positioning groove 33, and the limiting bulge 211 is correspondingly inserted into the limiting clamping groove 311, so that two adjacent lighting fixtures are fixedly connected. The structure ensures that four lighting fixtures 100 can be spliced to form a box-shaped splicing type composite lighting fixture. When all lighting fixtures are of the same length, they can form a square composite lighting fixture. When two opposite lighting fixtures are longer than the other two lighting fixtures, they can form a rectangular composite lighting fixture. After the assembly, one lighting fixture is connected to the power supply with the outgoing cable at the lamp panel. Please refer to FIG. 9, FIG. 10, and FIG. 11.

Embodiment 4

As illustrated in FIG. 12-FIG. 21, the lighting fixture described in this embodiment is a technical scheme based on Embodiment I. The second connecting part 3 consists of the first side face 36, the second side face 37, and the third side face 38, all of which form the connecting grooves 31, the third holes 312 are formed on the connecting groove 31 of the first side face 36, the connecting groove 31 of the second side face 37, and the connecting groove 31 of the third side face 38 respectively, the second conductive connector 32 is inserted into such three third holes 312, and the first conductive connector 22 is inserted into the second hole 214 of the connecting block 21. The structural arrangement ensures that when it is necessary to combine multiple lighting fixtures, the lighting fixtures can be connected at any side face of the second connecting part 3, so the shapes of the composite lighting fixtures that are spliced by multiple lighting fixtures are diversified, improving the aesthetics of the composite lighting fixtures. In addition, there are three pieces of the first conductive connectors 22 that are zero terminal, live terminal, and ground terminal respectively. Accordingly, there are three pieces of the second conductive connectors 32 that are zero terminal, live terminal, and ground terminal respectively. Furthermore, the second conductive connector 32 is of a connecting sleeve structure, since the first conductive connector 22 can be inserted into the second conductive connector 32.

Embodiment 5

Figure 22:
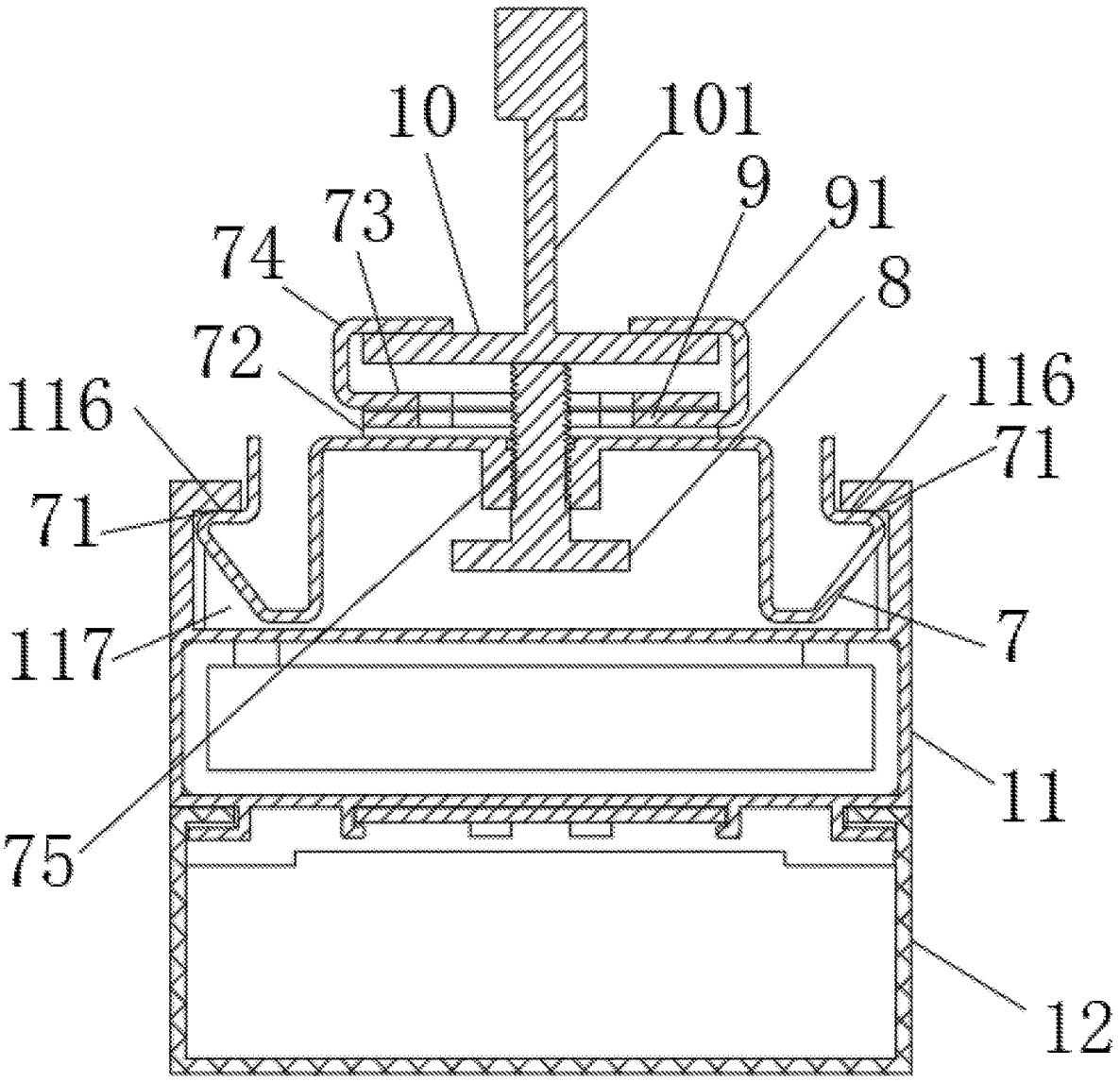
FIG. 22 is a schematic diagram of another lighting fixture installed with a suspension structure.
Figure 23:
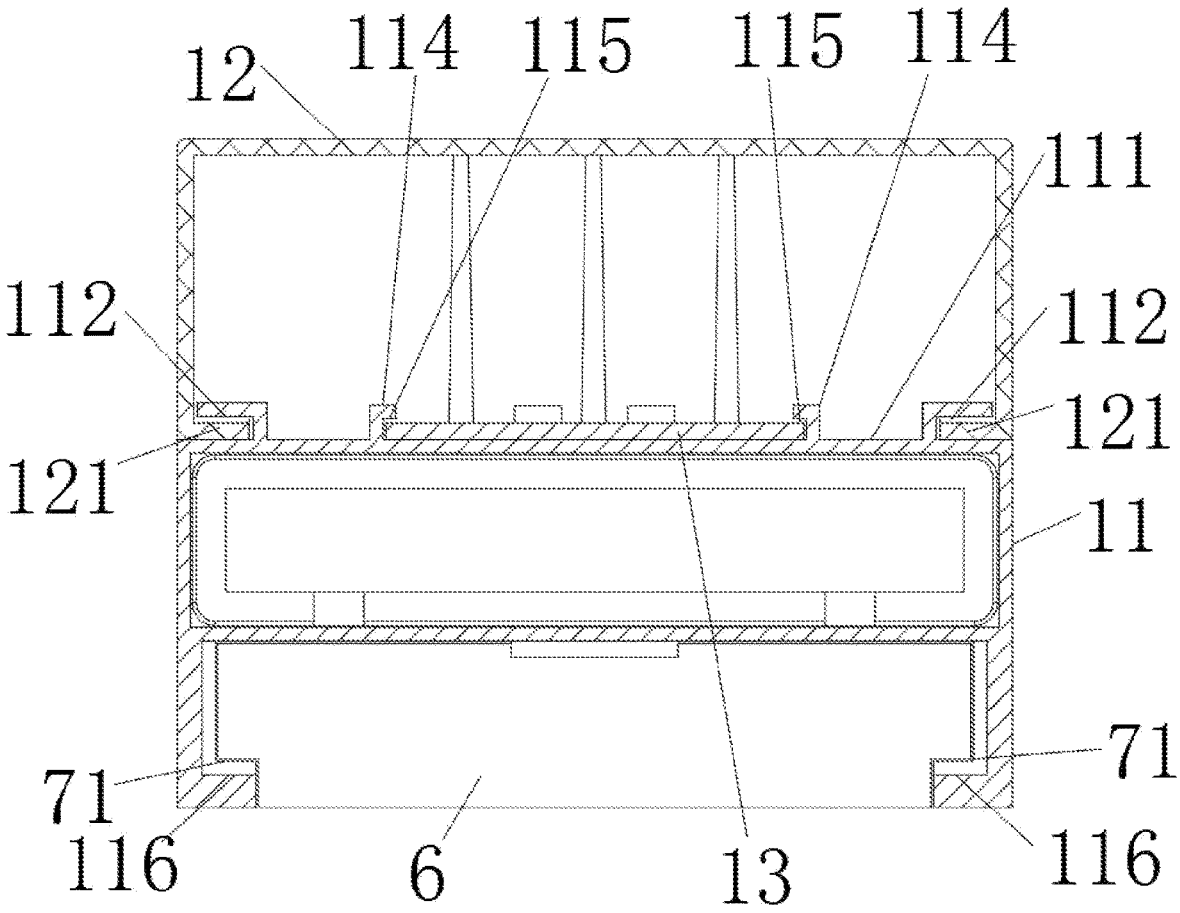
FIG. 23 is a structural diagram of another lighting fixture installed with a filling body.

As illustrated in FIG. 22 and FIG. 23, the lighting fixture described in this embodiment is a technical scheme based on Embodiment IV. In order to enable the lighting fixture to be installed at heights, a suspension structure can be installed on the back of the lamp housing. Specifically, a groove body 117 is arranged on the back of the lamp housing, a suspension frame 7 is arranged in the groove body 117 and connected to the inner wall of the groove body 117 through a clamping structure, a threaded hole 75 is arranged on the suspension frame 7, a bolt 8 is connected to threaded hole 75 through internal threads, a hanger frame is arranged above the suspension frame 7, is connected to the suspension frame 7 by a connecting frame 72, and consists of the first plate body 73 and the first hook body 74 at one end of the first plate body 73, the second plate body 9 is arranged between the hanger frame and the suspension frame 7, the second hook body 9 is arranged on the second plate body 91 on the side corresponding to the first hook body 74, a suspension plate 10 is arranged above the first plate body 73, a suspension rod 101 is arranged on the suspension plate 10, the bottom face of the suspension plate 10 and the screw end face of the bolt 8 contact each other, and the top faces of both ends of the suspension plate 10 contact the limiting parts of the first hook body 74 and the second hook body 91. The suspension rod 101 can be connected to the indoor ceiling, or can be subject to welding or threaded connection. In addition, the suspension structure is convenient to assemble and reliable. The suspension plate 10 and the suspension rod 101 are combined into an integral structure. The suspension frame 7, the first plate body 73, the connection frame 72, and the first hook body 74 are combined into an integral structure, the second plate body 9 and the second hook body 91 are combined into an integral structure. In addition, the suspension structure can be replaced by the filling body 6, and the filling body 6 is also limited by the clamping structure.

Preferably, the clamping structure consists of the first step 116 that is formed on two opposite side walls in the groove body and the second step 71 arranged on two opposite side walls on the suspension frame 7. The first step 116 and the second step 71 are clamped with each other.

Embodiment 6

Figure 24:
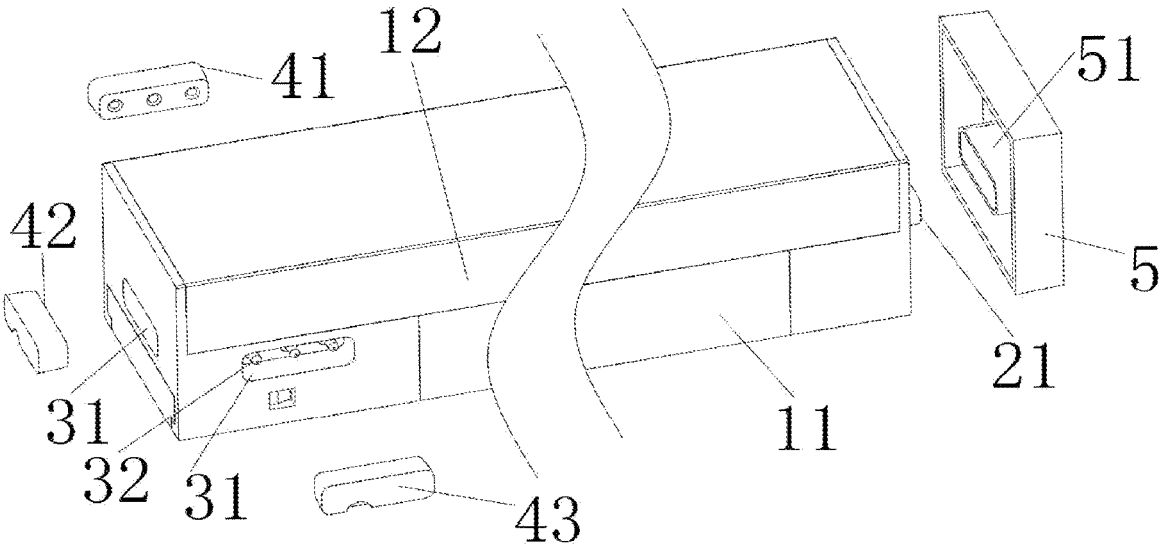
FIG. 24 is a structural diagram (I) of another lighting fixture installed with a plug and a sealing cap.

As illustrated in FIG. 24, the lighting fixture described in this embodiment is a technical scheme based on Embodiment IV. There are three plugs, i.e. the first plug 41, the second plug 42, and the third plug 43, among which the first plug 41 is inserted into the connecting groove 31 on the first side face 36, the second plug 42 is inserted into the connecting groove 31 on the second side face 37, and the third plug 43 is inserted into the connecting groove 31 on the third side face 38. The structure is suitable for a single lighting fixture, and when the connecting block 21 with the first conductive connector 22 is connected with the matching electrically connected adapter, the single lighting fixture can be used. The first plug 41, the second plug 42, and the third plug 43 are plugs made of silica gel.

Embodiment 7

Figure 25:
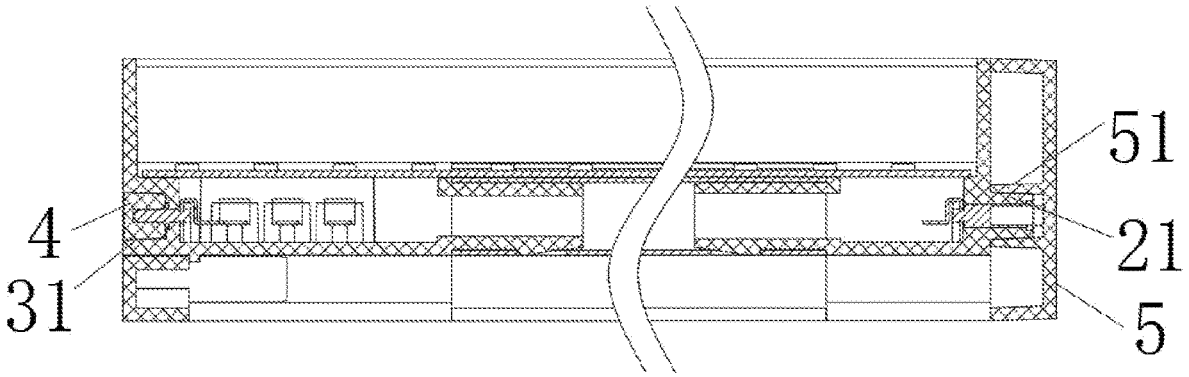
FIG. 25 is a structural diagram (II) of another lighting fixture installed with a plug and a sealing cap.
Figure 26:
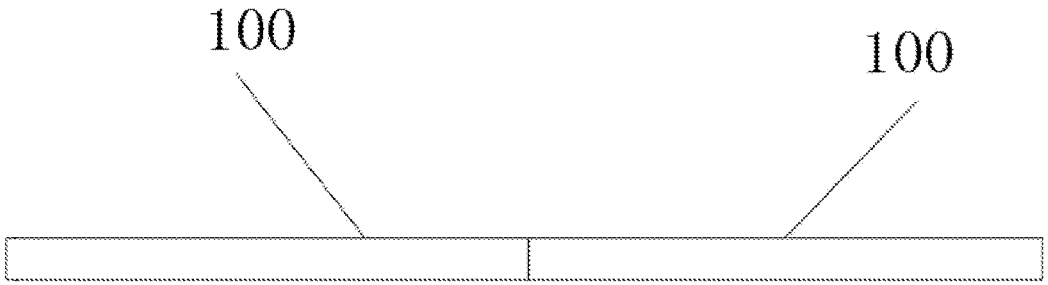
FIG. 26 is a schematic diagram of an I-shaped composite lighting fixture.
Figure 27:
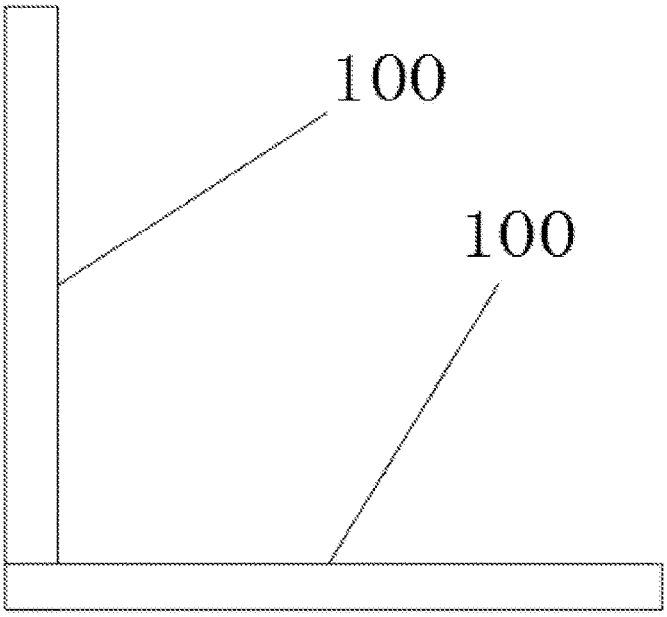
FIG. 27 is a schematic diagram of an L-shaped composite lighting fixture.
Figure 28:
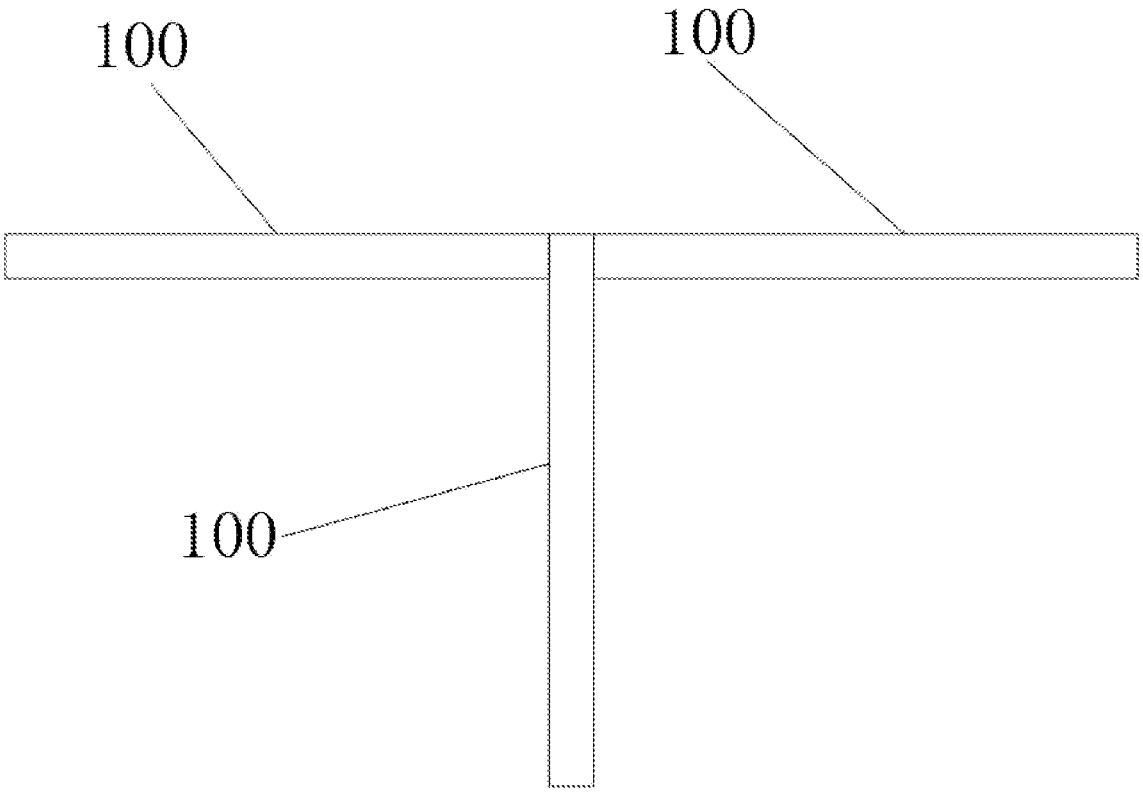
FIG. 28 is a schematic diagram of a T-shaped composite lighting fixture.
Figure 29:
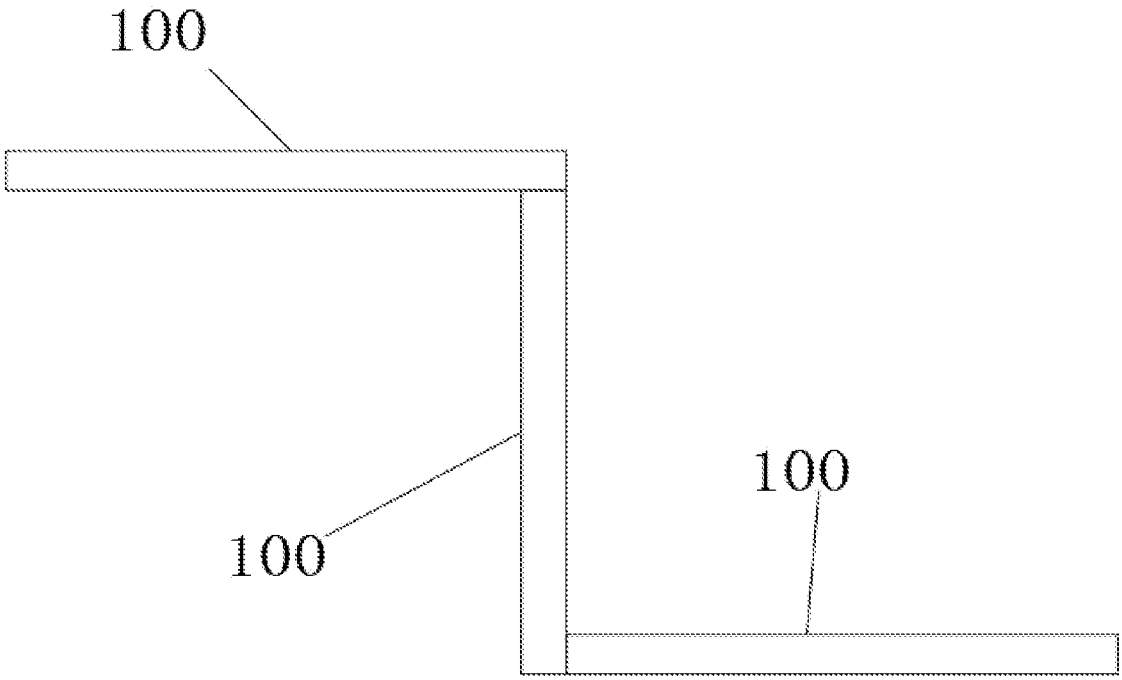
FIG. 29 is a schematic diagram of a Z-shaped composite lighting fixture.
Figure 30:
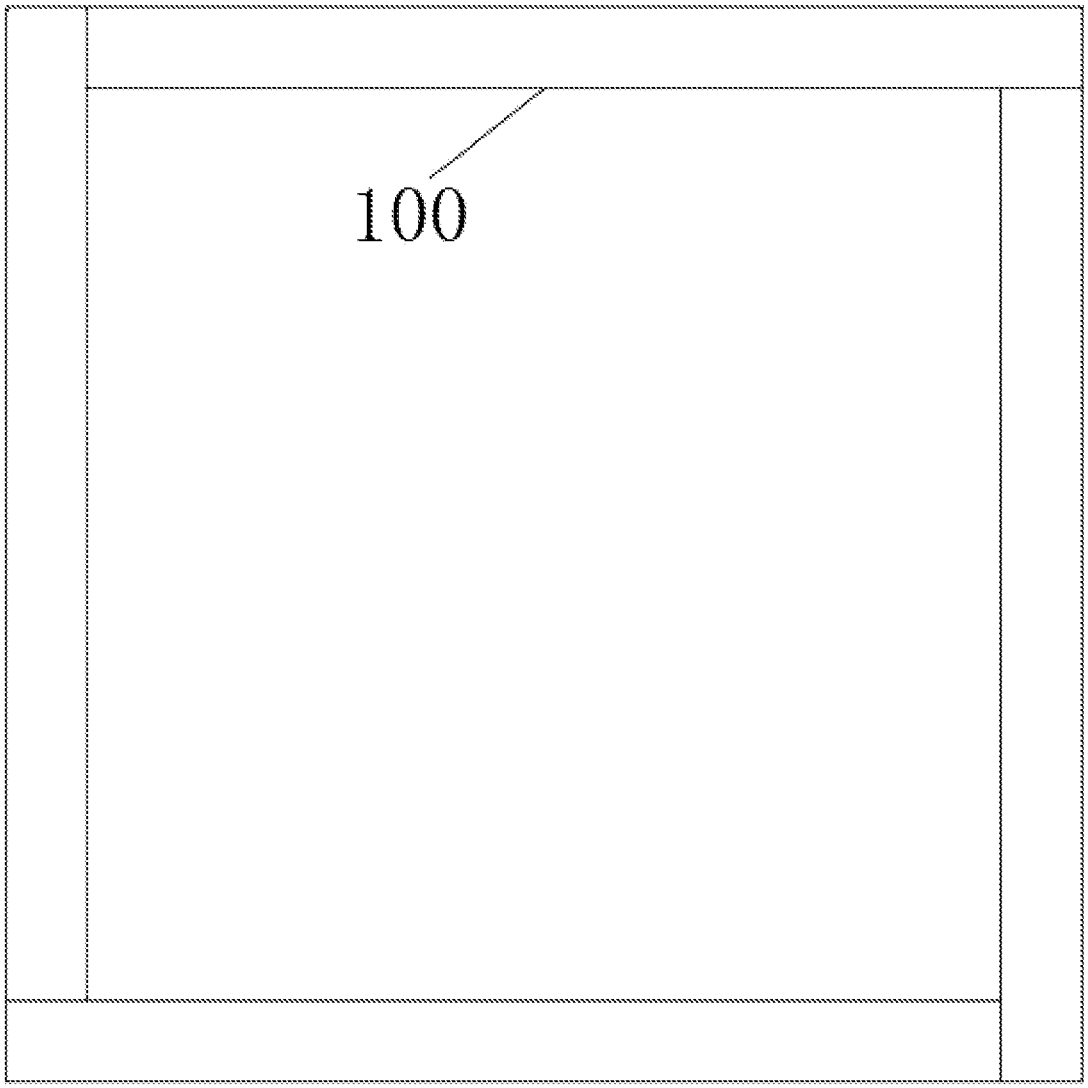
FIG. 30 is a schematic diagram of square composite lighting fixtures formed by another lighting fixture.

As illustrated in FIG. 24 and FIG. 25, the lighting fixture described in this embodiment is a technical scheme based on Embodiment IV and Embodiment VI. There is a sealing cap 5 that is covered on the end face of the first connecting part 2, and there is a sleeve body 51 formed in the sealing cap 5 and sleeved onto the connecting block 21. When the connecting grooves 31 of two side faces are blocked by plugs and the connecting groove 31 of the remaining side face is not blocked, the unblocked connecting groove 31 with the second conductive connector 32 can be connected with the matching electrically connected adapter so that the single lighting fixture can be used. During transportation, the connecting grooves 31 on three side faces of a single lighting fixture and the section with the connecting block 21 can be blocked, thus achieving reliable transportation.

Embodiment 8

A composite structure of lighting fixtures described in this embodiment consists of several lighting fixtures 100 according to Embodiment W, in two adjacent lighting fixtures 100, the first connecting part 2 of one lighting fixture and the second connecting part 3 of the other lighting fixture contact each other, and the connecting block 21 of one lighting fixture is inserted in the connecting groove 31 of the other lighting fixture, so the first conductive connector 22 is inserted into the connecting groove 31 on any side face of the second connecting part 3 and contacts the second conductive connector 32, thus forming a conductive connection. Specifically, the connecting block 21 of the first connecting structure in one lighting fixture is inserted into the connecting groove 31 of the first side face 36 of the other lighting fixture to form an L-shaped splicing type composite lighting fixture; alternatively, the connecting block 21 of the first connecting structure in one lighting fixture is inserted into the connecting groove 31 of the second side face 37 of the other lighting fixture to form an I-shaped splicing type composite lighting fixture; alternatively, when three lighting fixtures are used, the connecting block 21 of the first connecting structure in one side lighting fixture is inserted into the connecting groove 31 of the first side face 36 in the middle lighting fixture, and the connecting block 21 of the first connecting structure in the other side lighting fixture is inserted into the connecting groove 31 of the second side face 37 in the middle lighting fixture to form a T-shaped splicing type composite lighting fixture; alternatively, when three lighting fixtures 100 are used, the connecting block 21 of the first connecting structure in the middle lighting fixture is inserted into the connecting groove 31 of the third side face 38 of one side lighting fixture, and the connecting block 21 of the first connecting structure in one side lighting fixture is inserted into the connecting groove 31 of the third side face 38 of the middle lighting fixture to form a Z-shaped splicing type composite lighting fixture, wherein the connecting groove 31 and the connecting block 21 are fixed by interference fit, the connecting block 21 is a bevel, and the connecting groove 31 is a groove connected with the bevel by interference fit; alternatively, four lighting fixtures 100 can be combined into a box-shaped composite lighting fixture. After the assembly, one lighting fixture is connected to the power supply with the outgoing cable at the lamp panel. Please refer to FIG. 26 to FIG. 30.

The present invention is not limited to the above-mentioned preferred embodiments. Anyone may get other products in various forms under the inspiration of the present invention. However, whatever changes are made in the shape or structure of the products, any products with the same or similar technical schemes to the present application will fall within the scope of protection of the present invention.

What is claimed is:

1. A lighting fixture, which is characterized in that it consists of a light bar body, the light bar body consists of the first connecting part and the second connecting part, the first connecting structure is arranged on the first connecting part, the second connecting structure connecting to the first connecting structure is arranged on the second connecting part, the first connecting structure consists of a connecting block and the first conductive connector, the second connecting structure consists of a connecting groove and the second conductive connector, and the second conductive connector is arranged in the connecting groove, and the light bar body consists of a shell, a light-transmitting body, and a luminous source, the shell and the light-transmitting body are fixed to form a lamp housing, the luminous source is arranged between the shell and the light-transmitting body, the first plug-in block is arranged on the first connecting part and inserted into the inner cavity at one end of the lamp housing, and the second plug-in block is arranged on the second connecting part and inserted into the inner cavity at the other end of the lamp housing.

2. A lighting fixture according to claim 1, which is characterized in that the first conductive connector is inserted into the first hole of the first connecting part, and the contact part of the first conductive connector is exposed to the outside.

3. A lighting fixture according to claim 2, which is characterized in that the connecting block and the first connecting part are arranged perpendicular to each other, a limiting bulge is arranged on the connecting block, the first positioning groove is arranged near the connecting block on the second connecting part, and a limiting clamping groove is arranged in the first positioning groove.

4. A lighting fixture according to claim 3, which is characterized in that a positioning block is arranged on the connecting block, the positioning block is arranged perpendicular to the first connecting part and near the connecting block, and the second positioning groove is arranged on the second connecting part.

5. A lighting fixture according to claim 4, which is characterized in that the first catching groove is arranged on the wall of the inner cavity at one end of the lamp housing, the first catching block is arranged on the first plug-in block, and the first catching groove is inserted into the first catching groove.

6. A lighting fixture according to claim 5, which is characterized in that the second catching groove is arranged on the wall of the inner cavity at the other end of the lamp housing, the second catching block is arranged on the second plug-in block, and the second catching groove is inserted into the second catching groove.

7. A lighting fixture according to claim 1, which is characterized in that the second connecting part consists of the first side face, the second side face, and the third side face, all of which form in the connecting grooves, the connecting groove of the first side face, the third holes are formed on the connecting groove of the first side face, the connecting groove of the second side face, and the connecting groove of the third side face respectively, the second conductive connector is inserted into such three third holes, and the first conductive connector is inserted into the second hole of the connecting block.

8. A lighting fixture according to claim 7, which is characterized in that the first catching groove is arranged on the wall of the inner cavity at one end of the lamp housing, the first catching block is arranged on the first plug-in block, and the first catching groove is inserted into the first catching groove.

9. A lighting fixture according to claim 8, which is characterized in that the second catching groove is arranged on the wall of the inner cavity at the other end of the lamp housing, the second catching block is arranged on the second plug-in block, and the second catching groove is inserted into the second catching groove.

10. A lighting fixture according to claim 9, which is characterized in that a groove body is arranged on the back of the lamp housing, a suspension frame is arranged in the groove body and connected to the inner wall of the groove body through a clamping structure, a threaded hole is arranged on the suspension frame, a bolt is connected to threaded hole through internal threads, a hanger frame is arranged above the suspension frame, is connected to the suspension frame by a connecting frame, and consists of the first plate body and the first hook body at one end of the first plate body, the second plate body is arranged between the hanger frame and the suspension frame, the second hook body is arranged on the second plate body on the side corresponding to the first hook body, a suspension plate is arranged above the first plate body, a suspension rod is arranged on the suspension plate, the bottom face of the suspension plate and the screw end face of the bolt contact each other, and the top faces of both ends of the suspension plate contact the limiting parts of the first hook body and the second hook body.

11. A lighting fixture according to claim 7, which is characterized in that there are three plugs, i.e. the first plug, the second plug, and the third plug, among which the first plug is inserted into the connecting groove on the first side face, the second plug is inserted into the connecting groove on the second side face, and the third plug is inserted into the connecting groove on the third side face.

12. A lighting fixture according to claim 9, which is characterized in that there is a sealing cap that is covered on the end face of the first connecting part, and there is a sleeve body formed in the sealing cap and sleeved onto the connecting block.

13. A composite structure of lighting fixtures, which is characterized in that it consists of several lighting fixtures according to claim 6, in two adjacent lighting fixtures, the first connecting part of one lighting fixture and the second connecting part of the other lighting fixture contact each other, and the connecting block of one lighting fixture is inserted in the first positioning groove of the other lighting fixture, so the limiting bulge of one lighting fixture is buckled into the limiting clamping groove of the other lighting fixture, the positioning block is inserted into the second positioning groove, and the first conductive connector is inserted into the connecting groove and contacts the second conductive connector, thus forming a conductive connection.

14. A composite structure of lighting fixtures, which is characterized in that it consists of several lighting fixtures according to claim 10, in two adjacent lighting fixtures, the first connecting part of one lighting fixture and the second connecting part of the other lighting fixture contact each other, and the connecting block of one lighting fixture is inserted in the connecting groove of the other lighting fixture, so the first conductive connector s inserted into the connecting groove and contacts the second conductive connector, thus forming a conductive connection.

* * * * *